US010612809B2

(12) United States Patent
Vogel et al.

(10) Patent No.: US 10,612,809 B2
(45) Date of Patent: Apr. 7, 2020

(54) CONTROLLING TRANSMISSION INTERVALS IN AN HVAC SYSTEM BASED ON OPERATIONAL MODES OF THE HVAC SYSTEM

(71) Applicant: Emerson Electric Co, St. Louis, MO (US)

(72) Inventors: G. Scott Vogel, Fenton, MO (US); Rishi Siravuri, Maryland Heights, MO (US)

(73) Assignee: Emerson Electric Co., St. Louis, MO (US)

( * ) Notice: Subject to any disclaimer, the term of this patent is extended or adjusted under 35 U.S.C. 154(b) by 129 days.

(21) Appl. No.: 16/005,258

(22) Filed: Jun. 11, 2018

(65) Prior Publication Data

US 2019/0376716 A1 Dec. 12, 2019

(51) Int. Cl.

| | |
|---|---|
| ***F24F 11/46*** | (2018.01) |
| ***F24F 11/56*** | (2018.01) |
| ***F24F 11/65*** | (2018.01) |
| ***F24F 110/10*** | (2018.01) |
| ***F24F 110/20*** | (2018.01) |
| ***F24F 11/54*** | (2018.01) |
| *F24F 11/58* | (2018.01) |

(52) U.S. Cl.

CPC ..... *F24F 11/65* (2018.01); *F24F 11/46* (2018.01); *F24F 11/54* (2018.01); *F24F 11/56* (2018.01); *F24F 11/58* (2018.01); *F24F 2110/10* (2018.01); *F24F 2110/20* (2018.01)

(58) Field of Classification Search

CPC .. F24F 11/46; F24F 11/54; F24F 11/56; F24F 11/58; F24F 11/65; F24F 2110/10; F24F 2110/20

See application file for complete search history.

(56) References Cited

U.S. PATENT DOCUMENTS

| | | | | |
|---|---|---|---|---|
| 5,927,599 | A * | 7/1999 | Kath | G05D 23/1905 236/47 |
| 7,354,005 | B2 | 4/2008 | Carey et al. | |
| 2011/0001812 | A1 * | 1/2011 | Kang | G08B 13/00 348/77 |

(Continued)

*Primary Examiner* — Jennifer L Norton

(74) *Attorney, Agent, or Firm* — Harness, Dickey & Pierce, P.L.C.; Anthony G. Fussner

(57) ABSTRACT

An example HVAC system includes an HVAC component, and an HVAC controller configured to selectively control the HVAC component in a first operating mode and a second operating mode. The system also includes a sensor in communication with the HVAC controller. The sensor is configured to detect one or more parameters of the HVAC system and periodically transmit the one or more detected parameters to the HVAC controller. The sensor is also configured to transmit the one or more detected parameters according to a first transmission interval when the HVAC controller is operating in the first operating mode, and to transmit the one or more detected parameters according to a second transmission interval when the HVAC controller is operating in the second operating mode. The first transmission interval is different than the second transmission interval. Example methods of controlling an HVAC system are also disclosed.

18 Claims, 3 Drawing Sheets

(56) References Cited

U.S. PATENT DOCUMENTS

| | | | | |
|---|---|---|---|---|
| 2016/0077501 | A1* | 3/2016 | Loverich | H04W 4/38 700/12 |
| 2017/0176035 | A1 | 6/2017 | Reeder et al. | |
| 2017/0192042 | A1* | 7/2017 | Micali | G06F 16/9024 |
| 2018/0293820 | A1* | 10/2018 | Wang | B64D 43/02 |
| 2018/0318746 | A1* | 11/2018 | Thomas | G05B 15/02 |
| 2018/0372330 | A1* | 12/2018 | Ronda | G05B 15/02 |
| 2019/0273671 | A1* | 9/2019 | Alcala Perez | H04L 43/08 |

* cited by examiner

200 ↘

| Mode of operation | Idle/Active | Transmit interval [1] |
|---|---|---|
| OFF | Idle | 10 minutes |
| HEAT | Idle | 2 minutes |
| HEAT | Active | 30 seconds |
| HEAT | First 5 minutes after going idle | 30 seconds |
| COOL | Idle | 2 minutes |
| COOL | Active | 1 minute |
| COOL | First 5 minutes after going idle | 1 minute |

[1] Transmit interval times are hypothetical and only shown as a reference.

Fig. 2

CONTROLLING TRANSMISSION INTERVALS IN AN HVAC SYSTEM BASED ON OPERATIONAL MODES OF THE HVAC SYSTEM

FIELD

The present disclosure generally relates to controlling transmission intervals in an HVAC system based on operational modes of the HVAC system.

BACKGROUND

This section provides background information related to the present disclosure which is not necessarily prior art.

Electrical power is required to transmit messages in heating, ventilation and air conditioning (HVAC) systems. In many HVAC components, the power required to transmit data is far greater than the power required to acquire the data. More frequent transmissions of data will reduce available power at a faster rate. In battery-powered components, it is desirable to reduce power consumption to increase usable life of the components.

DRAWINGS

The drawings described herein are for illustrative purposes only of selected embodiments and not all possible implementations, and are not intended to limit the scope of the present disclosure.

FIG. 2 is table of example transmission intervals used in the HVAC system of FIG. 1.

DETAILED DESCRIPTION

Figure 1:
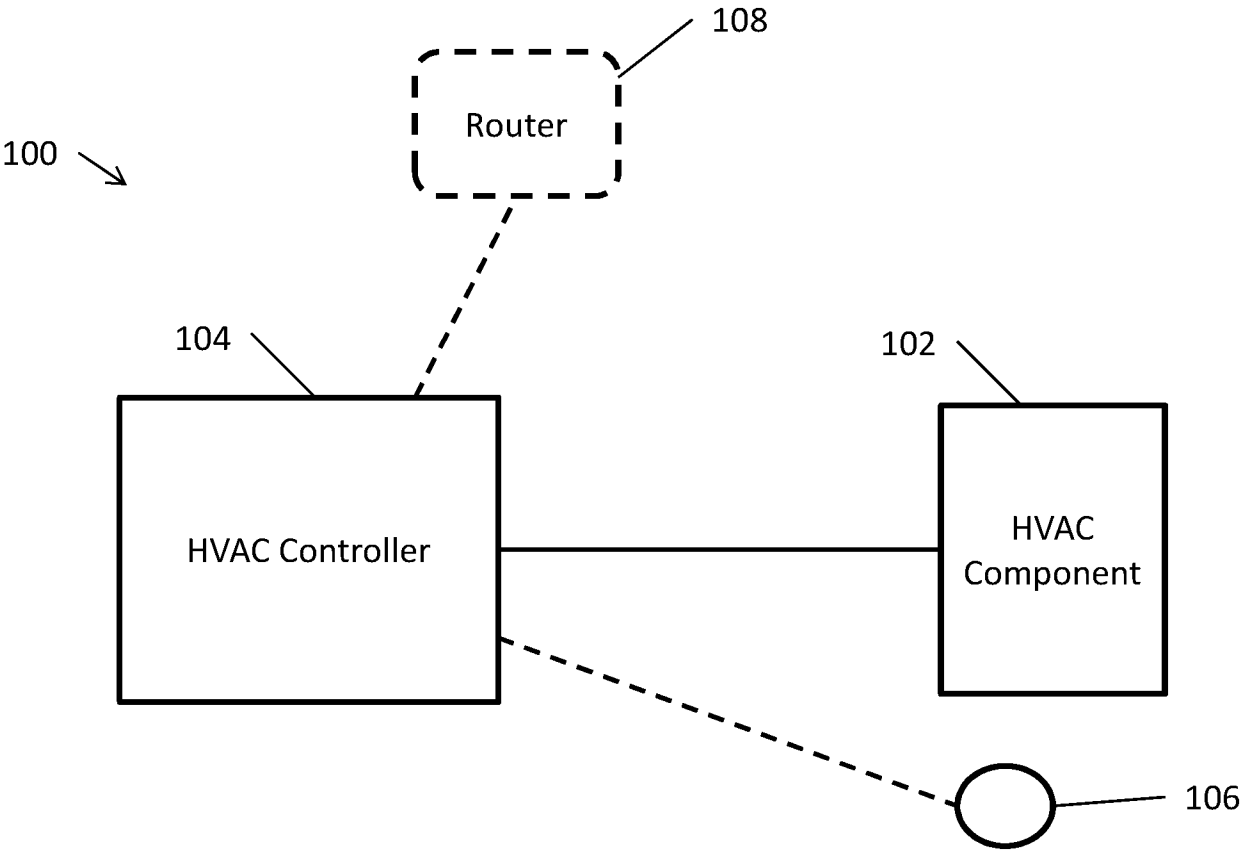
FIG. 1 is a block diagram of an HVAC system according to one exemplary embodiment of the present disclosure.

Example embodiments will now be described more fully with reference to the accompanying drawings.

Electrical power is required to transmit messages in heating, ventilation and air conditioning (HVAC) systems. In many HVAC components, the power required to transmit data is far greater than the power required to acquire the data. More frequent transmissions of data will reduce available power at a faster rate. In example embodiments described herein, transmission intervals can be adjusted based on an operating mode of the HVAC system to increase usable life of HVAC components.

Increasing the transmission interval between messages during periods where messages do not need to be transmitted as frequently can decrease average power consumption of an HVAC component. In battery-powered components, approaches described herein may result in longer HVAC component/batter life.

In some example embodiments described herein, sensor data is collected and transmitted to an HVAC controller, which can process the data to determine whether an action should be taken (e.g., control an HVAC component, etc.). In order to increase the useable life of a product, the sensor data may be transmitted at longer intervals (e.g., less frequent messages) when the sensor data is less critical for a current mode of operation of an HVAC system.

Different products may have specific requirements for receiving sensor data at different intervals, depending on how the sensor data will be used in the current operating mode. For example, a furnace control may need more frequent feedback from a return air temperature sensor and a supply air temperature sensor during a heating cycle, and less frequent feedback when the HVAC system is idle.

Similarly, a thermostat may require more frequent remote temperature sensor data when the HVAC system is operating in a heating mode or a cooling mode, and may require less frequent remote temperature sensor data when the HVAC system is off (e.g., idle, etc.). A sensor that provides data for relative humidity may send data more frequently when an HVAC system is operating in a mode capable of adjusting a fan speed for dehumidification, and may send data less frequently when the HVAC system is idle, when the HVAC system only uses relative humidity for display purposes, etc.

The data transmission interval could be sent from an HVAC controller to a sensor, could be requested from the HVAC controller by the sensor, etc. In some embodiments, the transmission interval could be determined by sensor itself (e.g., when the sensor is tailored for a specific application and receives the mode of operation from the HVAC controller, etc.).

As described further below, any suitable transmission interval periods could be used in an HVAC system. For example, a transmission interval of about ten minutes could be used when the HVAC system is in an off (e.g., idle) mode of operation, the transmission interval could be about two minutes when the HVAC system is in an idle state during a heating or cooling mode of operation, the transmission interval could be about one minute when the HVAC system is active in a cooling mode or operation or for the first five minutes after going idle in the cooling mode, the transmission interval could be about thirty seconds when the HVAC system is active in a heating mode of operation or for the first five minutes after going idle in a heating mode, etc. These example transmission intervals are for purposes of illustration only, and other embodiments could use any other suitable transmission intervals.

Example embodiments described herein may provide one or more (or none) of the following advantages: conserving available power by adjusting a transmit interval based on an operating mode of an HVAC system or HVAC controller, increasing product life by reducing the number of transmitted messages while data is not critical to HVAC system operation, improving product performance by sending sensor data more frequency when the data is more critical to HVAC system operation, etc.

In some example embodiments, an HVAC system may include at least one HVAC component and an HVAC controller. The HVAC controller is configured to selectively control the at least one HVAC component in a first operating mode and a second operating mode different than the first operating mode. The HVAC system also includes a sensor in communication with the HVAC controller. The sensor is configured to detect one or more parameters of the HVAC system and periodically transmit the one or more detected parameters to the HVAC controller.

Specifically, the sensor is configured to transmit the one or more detected parameters according to a first transmission interval when the HVAC controller is operating in the first operating mode, and the sensor is configured to transmit the one or more detected parameters according to a second transmission interval when the HVAC controller is operating in the second operating mode. The first transmission interval is different than the second transmission interval.

The first operating mode may be an active operating mode and the second operating mode may be an idle operating mode. In that case, the second transmission interval can be greater than the first transmission interval, so that data is transmitted more frequently when the system is active and more frequent data feedback is needed from the sensor.

Alternatively, or in addition, the first operating mode may include a heating operating mode and the second operating mode may include a cooling operating mode. In that case, the second transmission interval can be greater than the first transmission interval, so that data is transmitted more frequently when the system is operating in the heating mode and more frequent data feedback is needed from the sensor (e.g., because heating modes can create faster temperature changes than cooling modes, etc.).

In some cases, the HVAC controller is configured to transmit a value of a corresponding one of the first transmission interval and the second transmission interval to the sensor according to a current operating mode of the HVAC controller. In this way, the HVAC controller can instruct the sensor to transmit data according to a specific transmission interval, based on the operating mode of the HVAC controller.

Alternatively, or in addition, the sensor could be configured to request a value of a corresponding one of the first transmission interval and the second transmission interval from the HVAC controller according to a current operating mode of the HVAC controller. In this way, the sensor could request a transmission interval from the HVAC controller, so that the sensor can transmit data at an appropriate frequency.

In some embodiments, the sensor may be configured to receive a current mode of operation from the HVAC controller, and to determine a corresponding one of the first transmission interval and the second transmission interval in response to the received current mode of operation. For example, the sensor may store a database of different transmission intervals based on different operating modes of an HVAC system, and the sensor can make its own determination of transmission interval based on a received mode of operation of the HVAC system or HVAC controller.

As described above, the HVAC system may use at least two different transmission intervals based on at least two different modes of operation of the HVAC system or HVAC controller. However, any suitable number of transmission intervals and modes of operation could be used, and the number of different transmission intervals may or may not be the same as the number of different modes of operation. For example, there could be two or three (or more) different transmission intervals, two or three (or more) modes of operation, etc.

In one example, the HVAC controller is configured to selectively control the at least one HVAC component in a third operating mode different than the first operating mode and the second operating mode, the sensor is configured to transmit the one or more detected parameters according to a third transmission interval when the HVAC controller is operating in the third operating mode, and the third transmission interval is different than the first operating mode and the second operating mode.

The sensor may be configured to transmit data in response to a detected change in the HVAC system. For example, the sensor could be configured to determine whether a change in the one or more detected parameters has exceeded a specified threshold. When the change in the one or more detected parameters has exceeded the specified threshold, the sensor may transmit the one or more detected parameters to the HVAC controller before an end of a current transmission interval.

In some embodiments, the sensor may adjust one or more transmission intervals based on a detected occupancy, a detected proximity, a detected light value, a user input, a percentage change of the one or more detected parameters, a detected temperature, a detected humidity, a time of day, etc. The sensor may be configured to detect the one or more parameters using the same interval as the currently specified transmission interval (e.g., based on a current operating mode of the HVAC controller, etc.).

The sensor may communicate with the HVAC controller using any suitable communication connection. For example, the sensor may be wired to the HVAC controller, the sensor may be in wireless communication with the HVAC controller, etc. The sensor could be a remote temperature sensor, a return air temperature sensor, a supply air temperature sensor, a relative humidity sensor, etc.

The HVAC controller may include any suitable control for an HVAC system. For example, the HVAC controller could include a thermostat, a furnace controller, a dehumidification controller, a heat pump controller, etc. The HVAC component could be any suitable component that operates in an HVAC system, including but not limited to an air conditioner, a fan, a furnace, a blower, a water heater, a heat pump, etc.

Referring now to the figures, FIG. 1 illustrates an exemplary embodiment of an HVAC system 100 including at least one HVAC component 102 and an HVAC controller 104. The HVAC controller 104 is configured to selectively control the at least one HVAC component 102 in a first operating mode (e.g., idle, active, cooling, heating, etc.) and a second operating mode different than the first operating mode.

The HVAC system 100 also includes a sensor 106 in communication with the HVAC controller 104. The sensor 106 is configured to detect one or more parameters of the HVAC system 100 and periodically transmit the one or more detected parameters to the HVAC controller 104.

Specifically, the sensor 106 is configured to transmit the one or more detected parameters according to a first transmission interval when the HVAC controller 104 is operating in the first operating mode, and the sensor 106 is configured to transmit the one or more detected parameters according to a second transmission interval when the HVAC controller 104 is operating in the second operating mode. The first transmission interval is different than the second transmission interval.

The first operating mode may be an active operating mode and the second operating mode may be an idle operating mode. In that case, the second transmission interval can be greater than the first transmission interval, so that data is transmitted more frequently when the HVAC system 100 is active and more frequent data feedback is needed from the sensor 106.

Alternatively, or in addition, the first operating mode may include a heating operating mode and the second operating mode may include a cooling operating mode. In that case, the second transmission interval can be greater than the first transmission interval, so that data is transmitted more frequently when the HVAC system 100 is operating in the heating mode and more frequent data feedback is needed from the sensor 106 (e.g., because heating modes can create faster temperature changes than cooling modes, etc.).

As described herein, any suitable transmission intervals could be used in the HVAC system 100. FIG. 2 illustrates example transmission intervals 200 for the HVAC system 100, based on different operating modes of the HVAC system 100. In FIG. 2, a transmission interval of about ten minutes is be used when the HVAC system 100 is in an off (e.g., idle) mode of operation, and data from the sensor is not needed very frequently.

When the HVAC system 100 is in an idle state during a heating or cooling mode of operation (e.g., not currently running an air conditioner, a furnace, etc.), the transmission interval decreases to about two minutes. This allows the HVAC controller 104 to receive more frequent updates of the sensor data than when the HVAC system 100 is off.

When the HVAC system 100 is active in a cooling mode (e.g., actively running an air conditioner, etc.), or for short period (e.g., three minutes, five minutes, etc.) after going idle in the cooling mode, the transmission interval is about one minute. This allows the HVAC controller 104 to respond more quickly in response to the effects of the air conditioner actively changing the temperature in the HVAC system 100, etc.

When the HVAC system 100 is active is in a heating mode (e.g., actively running a furnace, etc.), or for a short period (e.g., three minutes, five minutes, etc.) after going idle in the heating mode, the transmission interval is be about thirty seconds. This allows the HVAC controller 104 to respond even more quickly in response to the effects of the furnace actively changing the temperature in the HVAC system 100, etc. For example, a furnace may create faster changes in air temperature in the HVAC system 100 than an air conditioner, so a shorter transmission interval may be used in a heating mode than in a cooling mode. The example transmission intervals described in FIG. 2 are for purposes of illustration only, and any other suitable transmission intervals could be used in other embodiments.

Referring back to FIG. 1, the sensor 106 may be configured to determine the transmission interval using any suitable technique. For example, in some cases the HVAC controller 104 is configured to transmit a value of a corresponding one of the first transmission interval and the second transmission interval to the sensor 106 according to a current operating mode of the HVAC controller 104. In this way, the HVAC controller 104 can instruct the sensor 106 to transmit data according to a specific transmission interval, based on the operating mode of the HVAC controller 104.

Alternatively, or in addition, the sensor 106 could be configured to request a value of a corresponding one of the first transmission interval and the second transmission interval from the HVAC controller 104 according to a current operating mode of the HVAC controller 104. In this way, the sensor 106 could request a transmission interval from the HVAC controller 104, so that the sensor 106 can transmit data at an appropriate frequency.

In some embodiments, the sensor 106 may be configured to receive a current mode of operation from the HVAC controller 104, and to determine a corresponding one of the first transmission interval and the second transmission interval in response to the received current mode of operation.

For example, the sensor 106 may store a database of different transmission intervals based on different operating modes of an HVAC system 100, and the sensor 106 can make its own determination of transmission interval based on a received mode of operation of the HVAC system 100 or HVAC controller 104.

The sensor 106 may communicate with the HVAC controller using any suitable communication connection. FIG. 1 illustrates the sensor 106 in wireless communication with the HVAC controller 104. For example, the sensor 106 may be a battery-powered device including a wireless communication interface. The sensor 106 may communicate with the HVAC controller 104 using any suitable wireless communication protocol, such as Wi-Fi, radio frequency (RF) communication, short-range wireless communication (e.g., BLUETOOTH), etc.

In other embodiments, the sensor 106 may be wired to the HVAC controller 104. The sensor 106 and/or HVAC controller 104 may use power-stealing. For example, the sensor 106 and/or HVAC controller 104 may receive less than full required power of the sensor 106 and/or HVAC controller 104 from a power source (e.g., a utility grid, wiring of the HVAC system 100, etc.), and the sensor 106 and/or HVAC controller 104 may supplement remaining required power with a battery, etc.

Although FIG. 1 illustrates only one sensor 106, other embodiments may include more than one sensor 106. Each sensor 106 is configured to detect one or more parameters of the HVAC system 100, which are then transmitted to the HVAC controller 104. Each sensor 106 may be located adjacent to an HVAC component 102, adjacent the HVAC controller 104, at a location in the HVAC system 100 remote from the HVAC component 102 and the HVAC controller 104, etc. Example sensors 106 include, but are not limited to, a remote temperature sensor, a return air temperature sensor, a supply air temperature sensor, a relative humidity sensor, etc.

The HVAC controller 104 may include any suitable control for an HVAC system 100. For example, the HVAC controller 104 could include a thermostat, a furnace controller, a dehumidification controller, a heat pump controller, etc. As shown in FIG. 1, the HVAC controller 104 is optionally in communication with a router 108. The router 108 could be any suitable router, such as a Wi-Fi router, etc.

The HVAC controller 104 may transmit data to the router 108 according to different transmission intervals, based on a current operating mode of the HVAC controller 104, the HVAC system 100, etc. For example, if the HVAC controller 104 is battery-powered, uses power-stealing, etc., the HVAC controller 104 may conserve power by transmitting data less frequently when data is less important for a current mode of operation. The transmission intervals could be the same as or different than the transmission intervals described herein for communication from the sensor 106.

Although FIG. 1 illustrates only one HVAC component 102, other embodiments may include more than one HVAC component 102, and the HVAC controller 104 could be configured to control each HVAC component 102. For example, in an HVAC system 100 having an air conditioner, a fan, and a furnace, the HVAC controller 104 could include a thermostat configured to control all of the air conditioner, the fan and the furnace. Example HVAC components include, but are not limited to, an air conditioner, a fan, a furnace, a blower, a water heater, a heat pump, etc.

Figure 3:
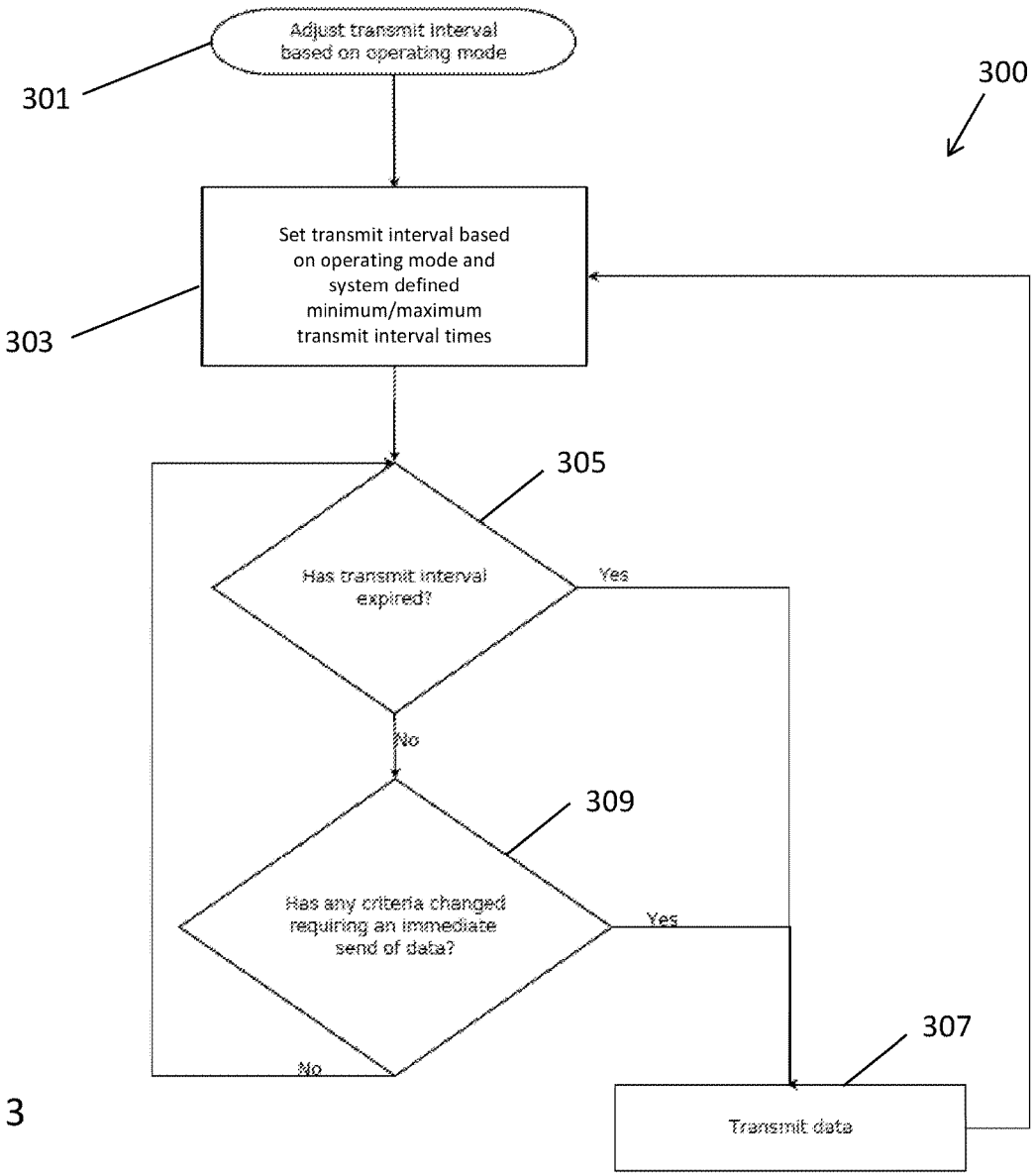
FIG. 3 is a flow chart of a process for transmitting data from a sensor to an HVAC controller, according to another exemplary embodiment of the present disclosure.

FIG. 3 illustrates an example process 300 for transmitting data from the sensor 106 to the HVAC controller 104. At 301, the sensor 106 adjusts a transmission interval based on a current operating mode of the HVAC controller 104 or the HVAC system 100. At 303, the sensor 106 adjusts the transmission interval based on a current operating mode and minimum/maximum transmission interval time periods as specified by the HVAC system 100.

For example, the HVAC system 100 (including the HVAC controller 104) could require at least five seconds, ten seconds, thirty seconds, etc. between each transmission of data as a minimum, could require no more than two minutes, five minutes, ten minutes, etc. between each transmission of data as a maximum, etc. In this case, if the sensor 106 attempts to adjust a transmission interval outside of a min/max range of the HVAC system 100 at 301, the sensor may bring the transmission interval within the min/max range at 303.

At 305, the sensor 106 determines whether the current transmission interval has expired and if yes, proceeds to transmit detected parameter data to the HVAC controller 104 at 307. If the current transmission interval has not expired at 305, the sensor 106 proceeds to determine whether any criteria has changed requiring an immediate send of data at 309.

For example, the sensor 106 could be configured to determine whether a change in the one or more detected parameters has exceeded a specified threshold (e.g., a temperature change of more than 0.3 degrees, etc.). When the change in the one or more detected parameters has exceeded the specified threshold, the sensor 106 may transmit the one or more detected parameters to the HVAC controller 104 before an end of a current transmission interval.

The sensor 106 and/or HVAC controller 104 may adjust one or more transmission intervals based on a detected occupancy, a detected proximity, a detected light value, a user input, a percentage change of the one or more detected parameters, a detected temperature, a detected humidity, a time of day, etc.

For example, the sensor 106 and/or HVAC controller 104 may use shorter transmission intervals when a user is present in a space of the HVAC system 100, as determined based on occupancy, proximity, time of day, etc. When a user is not present, the sensor 106 and/or HVAC controller 104 may use longer transmission intervals.

The process 300 of FIG. 3 could be performed by the HVAC controller 104. For example, FIG. 1 illustrates the HVAC controller 104 in communication with an optional router 108. In that case, the HVAC controller 104 could be configured to selectively control the HVAC component 102 in a first operating mode and a second operating mode different than the first operating mode, and to periodically transmit one or more control signals to the HVAC component 102 and/or the router 108.

The HVAC controller 104 could be configured to transmit the one or more control signals according to a first transmission interval when the HVAC controller 104 is operating in the first operating mode, and to transmit the one or more control signals according to a second transmission interval when the HVAC controller 104 is operating in the second operating mode, where the first transmission interval is different than the second transmission interval.

The HVAC controller 104 and sensor 106 may be configured to perform operations using any suitable combination of hardware and software. For example, the HVAC controller 104 and sensor 106 may include any suitable circuitry, logic gates, microprocessor(s), computer-executable instructions stored in memory, etc., operable to cause the HVAC controller 104 and sensor 106 to perform actions described herein (e.g., determining a specified transmission interval according to a current operating mode of the HVAC system, etc.).

According to another example embodiment of the present disclosure, a method of controlling an HVAC system is disclosed. The HVAC system includes an HVAC component, an HVAC controller, and a sensor in communication with the HVAC controller. The exemplary method includes selectively controlling, by the HVAC controller, the HVAC component in a first operating mode and a second operating mode different than the first operating mode.

The method also includes detecting, by the sensor, one or more parameters of the HVAC system, and periodically transmitting, by the sensor, the one or more detected parameters to the HVAC controller. The one or more detected parameters are transmitted according to a first transmission interval when the HVAC controller is operating in the first operating mode, and are transmitted according to a second transmission interval when the HVAC controller is operating in the second operating mode. The first transmission interval is different than the second transmission interval.

Selectively controlling may include selectively controlling the HVAC component in a third operating mode different than the first operating mode and the second operating mode. Periodically transmitting may include periodically transmitting the one or more detected parameters according to a third transmission interval when the HVAC controller is operating in the third operating mode. The third transmission interval is different than the first operating mode and the second operating modes.

In some embodiments, the method includes transmitting, by the HVAC controller, a value of a corresponding one of the first transmission interval and the second transmission interval to the sensor according to a current operating mode of the HVAC controller. Alternatively, or in addition, the method includes requesting, by the sensor, the value of the corresponding one of the first transmission interval and the second transmission interval from the HVAC controller according to the current operating mode of the HVAC controller.

The method may include receiving, by the sensor, a current mode of operation from the HVAC controller, and determining, by the sensor, a corresponding one of the first transmission interval and the second transmission interval in response to the received current mode of operation.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heating, ventilation and air conditioning (HVAC) system comprising:

at least one HVAC component;

an HVAC controller, the HVAC controller configured to selectively control the at least one HVAC component in a first operating mode and a second operating mode different than the first operating mode; and a sensor in communication with the HVAC controller, the sensor configured to detect one or more parameters of the HVAC system and periodically transmit the detected one or more parameters to the HVAC controller, wherein:

the sensor is configured to transmit the detected one or more parameters according to a first transmission interval when the HVAC controller is operating in the first operating mode;

the sensor is configured to transmit the detected one or more parameters according to a second transmission interval when the HVAC controller is operating in the second operating mode; and the first transmission interval is different than the second transmission interval;

wherein the sensor is configured to:

determine whether a change in the detected one or more parameters has exceeded a specified threshold; and when the change in the detected one or more parameters has exceeded the specified threshold, transmit the detected one or more parameters to the HVAC controller before an end of a current transmission interval.

2. The HVAC system of claim 1, wherein:

the first operating mode includes an active operating mode;

the second operating mode includes an idle operating mode; and the second transmission interval is greater than the first transmission interval.

3. The HVAC system of claim 1, wherein:

the first operating mode includes a heating operating mode;

the second operating mode includes a cooling operating mode; and the second transmission interval is greater than the first transmission interval.

4. The HVAC system of claim 1, wherein the HVAC controller is configured to transmit a value of a corresponding one of the first transmission interval and the second transmission interval to the sensor according to a current operating mode of the HVAC controller.

5. The HVAC system of claim 1, wherein the sensor is configured to request a value of a corresponding one of the first transmission interval and the second transmission interval from the HVAC controller according to a current operating mode of the HVAC controller.

6. The HVAC system of claim 1, wherein the sensor is configured to receive a current mode of operation from the HVAC controller, and to determine a corresponding one of the first transmission interval and the second transmission interval in response to the received current mode of operation.

7. The HVAC system of claim 1, wherein:

the HVAC controller is configured to selectively control the at least one HVAC component in a third operating mode different than the first operating mode and the second operating mode;

the sensor is configured to transmit the detected one or more parameters according to a third transmission interval when the HVAC controller is operating in the third operating mode; and the third transmission interval is different than the first operating mode and the second operating mode.

8. The HVAC system of claim 1, wherein the sensor is configured to detect the one or more parameters according to a current one of the first transmission interval and the second transmission interval.

9. The HVAC system of claim 1, wherein the HVAC controller is configured to adjust at least one of the first transmission interval and the second transmission interval in response to at least one of a detected occupancy, a detected proximity, a detected light value, a user input, a percentage change of the detected one or more parameters, a detected temperature, a detected humidity, and a time of day.

10. The HVAC system of claim 1, wherein the sensor is in wireless communication with the HVAC system controller.

11. The HVAC system of claim 1, wherein the sensor is in wired communication with the HVAC system controller.

12. The HVAC system of claim 1, wherein the HVAC system controller includes at least one of a thermostat, a furnace controller, a dehumidification controller, and a heat pump controller.

13. The HVAC system of claim 12, wherein the sensor includes at least one of a remote temperature sensor, a return air temperature sensor, a supply air temperature sensor, and a relative humidity sensor.

14. The HVAC system of claim 13, wherein the HVAC component includes at least one of an air conditioner, a fan, a furnace, a blower, a water heater, and a heat pump.

15. A method of controlling a heating, ventilation and air conditioning (HVAC) system including an HVAC component, an HVAC controller, and a sensor in communication with the HVAC controller, the method comprising:

selectively controlling, by the HVAC controller, the HVAC component in a first operating mode and a second operating mode different than the first operating mode;

detecting, by the sensor, one or more parameters of the HVAC system; and periodically transmitting, by the sensor, the detected one or more parameters to the HVAC controller, wherein:

the detected one or more parameters are transmitted according to a first transmission interval when the HVAC controller is operating in the first operating mode;

the detected one or more parameters are transmitted according to a second transmission interval when the HVAC controller is operating in the second operating mode; and the first transmission interval is different than the second transmission interval;

wherein the sensor is configured to:

determine whether a change in the one or more detected parameters has exceeded a specified threshold; and when the change in the one or more detected parameters has exceeded the specified threshold, transmit the one or more detected parameters to the HVAC controller before an end of a current transmission interval.

16. The method of claim 15, wherein:

selectively controlling further includes selectively controlling the HVAC component in a third operating mode different than the first operating mode and the second operating mode;

periodically transmitting further includes periodically transmitting the detected one or more parameters according to a third transmission interval when the HVAC controller is operating in the third operating mode; and the third transmission interval is different than the first operating mode and the second operating mode.

17. The method of claim 16, further comprising:

transmitting, by the HVAC controller, a value of a corresponding one of the first transmission interval and the second transmission interval to the sensor according to a current operating mode of the HVAC controller; or requesting, by the sensor, the value of the corresponding one of the first transmission interval and the second transmission interval from the HVAC controller according to the current operating mode of the HVAC controller.

18. The method of claim 16, further comprising:

receiving, by the sensor, a current mode of operation from the HVAC controller, and determining, by the sensor, a corresponding one of the first transmission interval and the second transmission interval in response to the received current mode of operation.

* * * * *